US005579831A

United States Patent [19]

Brucher

[11] Patent Number: 5,579,831

[45] Date of Patent: Dec. 3, 1996

[54] HEAT EXCHANGER FOR COOLING CRACKED GAS

[75] Inventor: Peter Brucher, Berlin, Germany

[73] Assignee: Deutsche Babcock-Borsig AG, Berlin, Germany

[21] Appl. No.: 519,238

[22] Filed: Aug. 25, 1995

[30] Foreign Application Priority Data

Dec. 21, 1994 [DE] Germany ..... 44 45 687.5

[51] Int. Cl.[6] ..... F28F 19/00

[52] U.S. Cl. ..... 165/134.1; 165/154

[58] Field of Search ..... 165/134.1, 154, 165/160

[56] References Cited

U.S. PATENT DOCUMENTS

| | | | |
|---|---|---|---|
| 4,589,473 | 5/1986 | Kehrer | 165/1 |
| 4,700,773 | 10/1987 | Kehrer | 165/134.1 |
| 4,848,449 | 7/1989 | Brücher et al. | 165/160 |
| 5,035,283 | 7/1991 | Brücher et al. | 165/134.1 |
| 5,088,551 | 2/1992 | Brücher et al. | 165/134.1 |
| 5,425,415 | 6/1995 | Master et al. | 165/154 |

*Primary Examiner*—Allen J. Flanigan
*Attorney, Agent, or Firm*—Max Fogiel

[57] ABSTRACT

A heat exchanger for cooling cracked gas. At least one cooling pipe (4) is enclosed in an outer pipe (6). Both pipes are welded at each end to a water compartment (7 & 8). The water compartment supplies and removes a coolant. Each water compartment comprises a solid strip with as many separated and circular depressions (11) introduced into it as there are cooling pipes. Each depression surrounds a cooling pipe. The diameter of each depression equals or exceeds the inside diameter of the outer pipe. Each depression has a thin annular floor (12) with a slight residual thickness in the vicinity of the ends of the cooling pipes.

6 Claims, 3 Drawing Sheets

HEAT EXCHANGER FOR COOLING CRACKED GAS

BACKGROUND OF THE INVENTION

The present invention concerns a heat exchanger for cooling cracked gas.

The gas is produced by thermally cracking hydrocarbons in a cracking furnace. Cracking furnaces have a number of externally heated cracking pipes. The hydrocarbons are conveyed through the pipes accompanied by steam. The gas leaves the pipe at approximately 800° to 850° C. and must be cooled very rapidly to stabilize its molecular composition. This is done in coolers by transmitting heat from the gas to a highly compressed evaporating water.

Cracked-gas cooling systems wherein each pipe extending out of the furnace communicates with its own cooler are known. Each cooler can have one or more pipes. The pipes can all be accommodated in one jacket or be double. Since the pipes leaving the furnace are usually aligned relatively close together, all of the coolers can be combined into a module, constituting a linear cooler. Coolant is introduced and removed at the ends of the pipes and by way of water-filled compartments, which can be elliptical or cylindrical. The compartments communicate with all the pipes in the system.

SUMMARY OF THE INVENTION

The object of the present invention is to improve the water compartment in the generic heat exchanger in order to eliminate overheating of the surfaces participating in the heat exchange, precisely define the flow of the incoming coolant, and render the water compartments both strong enough to resist the pressure of the coolant and cost-effective to manufacture.

The pressure of the coolant in the heat exchanger in accordance with the present invention acts on a relatively narrow annular area representing the floor of the depression. The outside diameter of that area is essentially no longer than the inside diameter of the outer pipe. Due to the smallness of the area subject to the pressure of the coolant, the floor does not need to be very thick. The thin floor allows the coolant to cool the heated floor satisfactorily, avoiding overheating. Apart from the depressions, which are somewhat separated from one another, the water compartment is as thick as the original solid piece. The compartment is accordingly essentially inherently rigid enough to resist the high pressure of the coolant without reinforcements. The depressions can be produced in the solid piece by such simple mechanical operations as boring and milling, decreasing the expense of manufacturing the water compartment. Since each cooling pipe has its own depression separated from the other pipes, each pipe can be handled individually by the coolant, resulting in a better distribution of coolant over that pipe. The depression, which is round in cross-section and is in particular associated with a tangential coolant intake, rotates the flowing coolant. The rotation improves the cooling action and prevents undesired deposition of particles out of the coolant. Any particles present are arrested by the cyclonic effect of the rotating coolant in the vicinity of the wall of the depression, whence they can be sluiced out through the rest of the outwardly extending bore during operation.

BRIEF DESCRIPTION OF THE DRAWING

One embodiment of the present invention will now be specified with reference to the accompanying drawing, wherein.

DESCRIPTION OF THE PREFERRED EMBODIMENT

Figure 1:
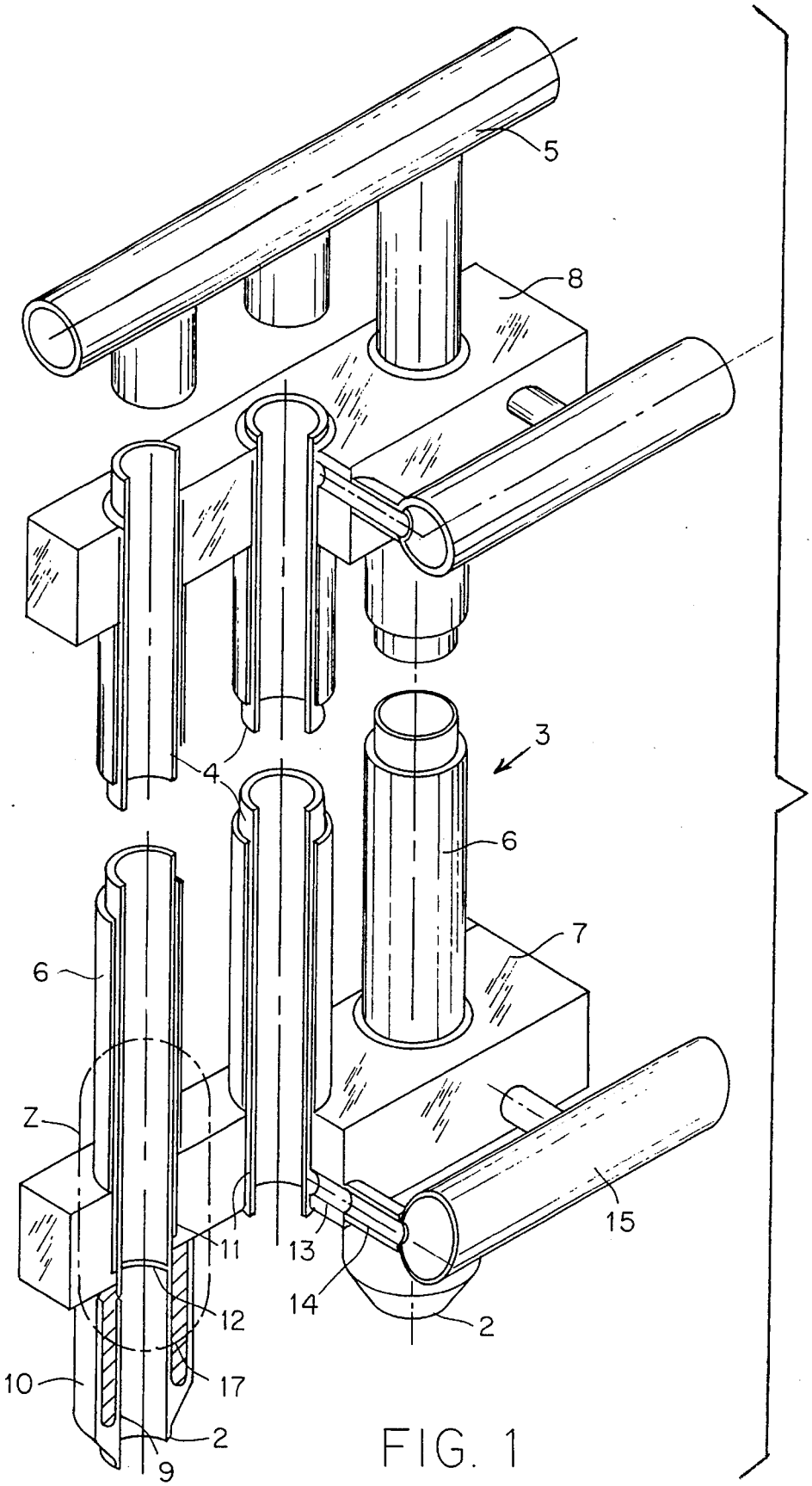
FIG. 1 is a perspective representation of a cracked-gas cooler.
Figure 2:
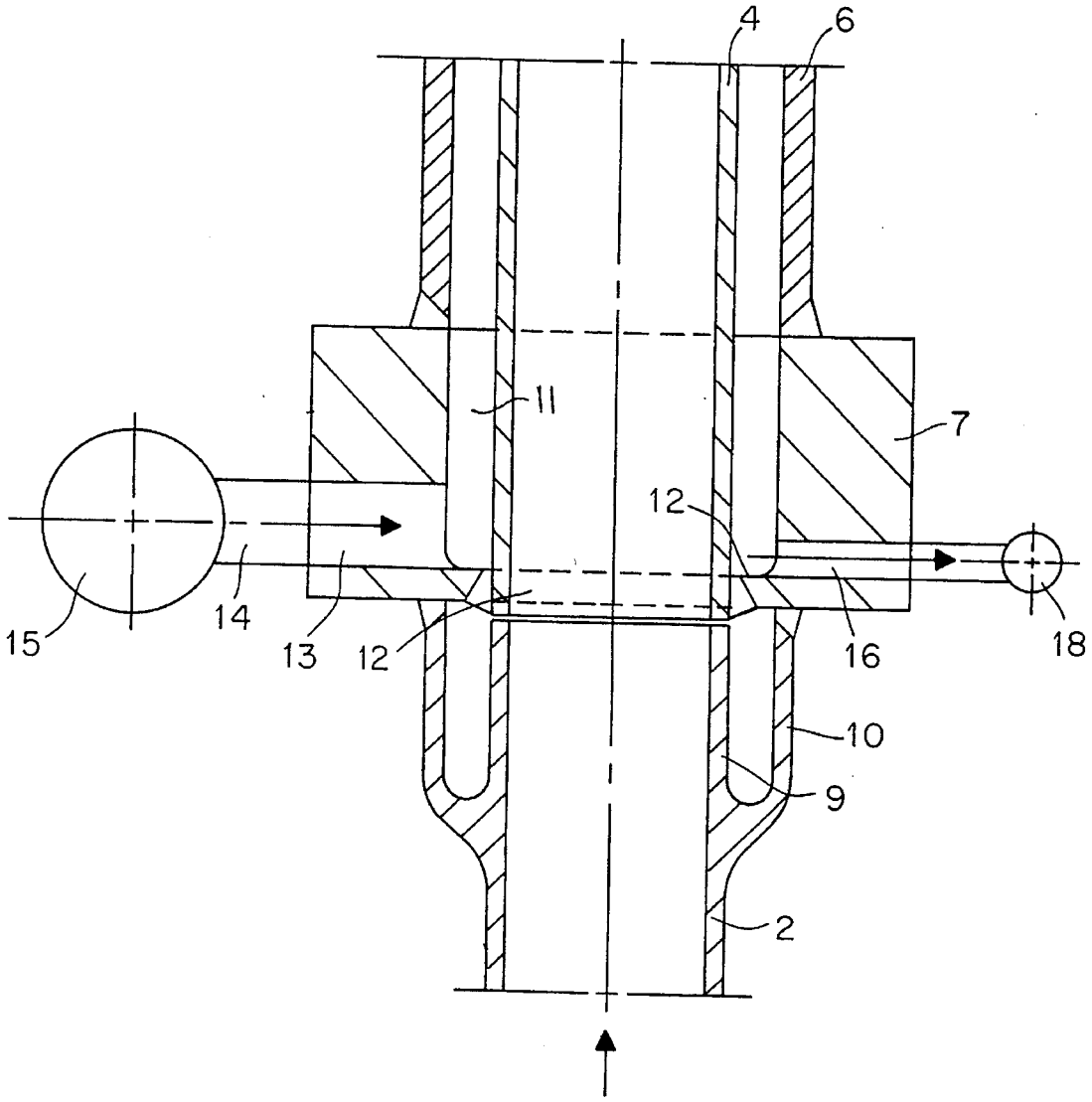
FIG. 2 is a longitudinal section through a cracked-gas cooler in the vicinity of the lower water compartment.
Figure 3:
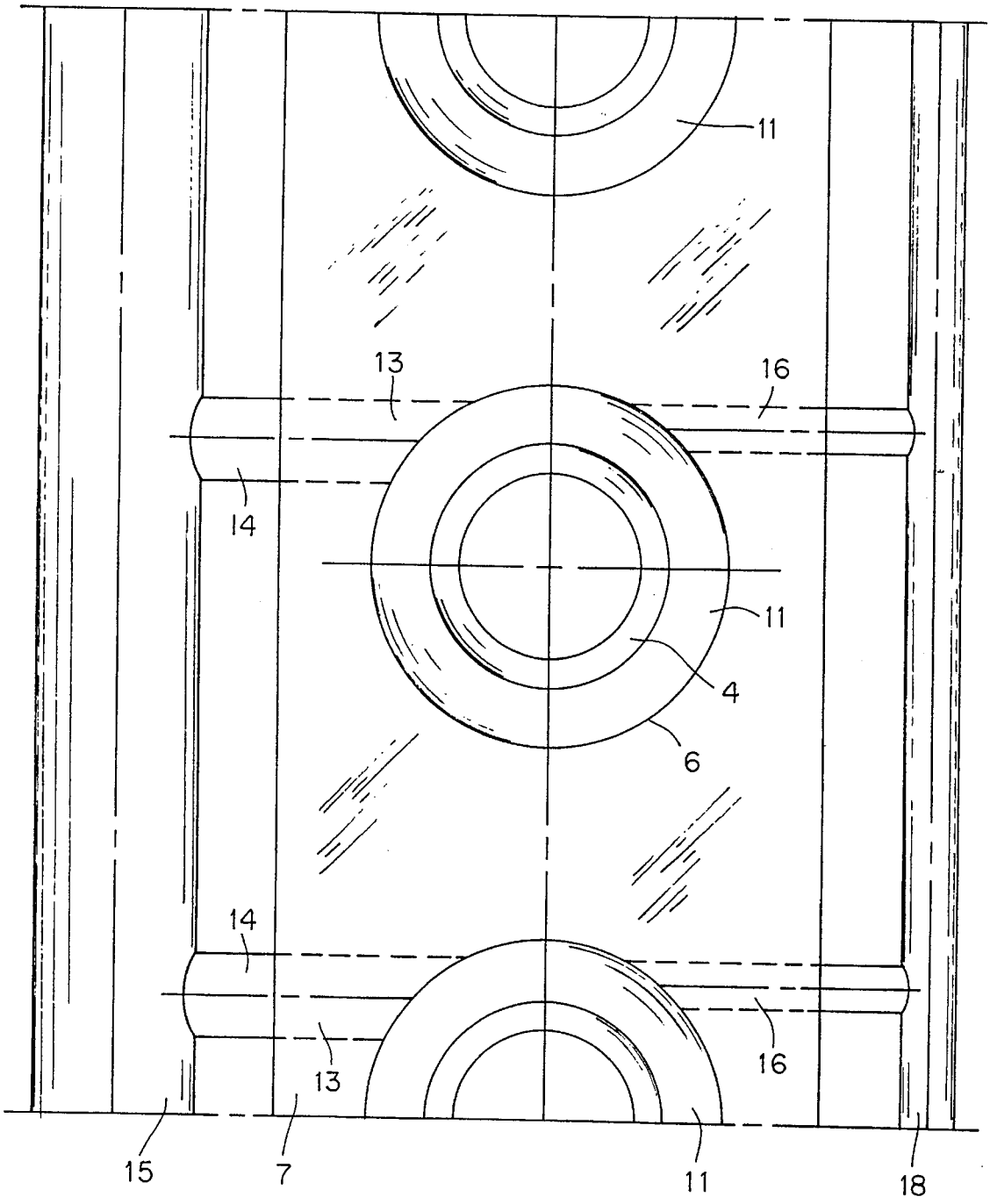
FIG. 3 is a top view of the area illustrated in FIG. 3.

A cracked gas is generated in a furnace by treating hydrocarbons with steam. The starting material flows through externally heated cracking pipes 2. The gas leaves cracking pipes 2 at 800° to 850° C. and arrives directly in a cooler 3 in the immediate vicinity above the furnace. The molecular composition of the gas is stabilized in cooler 3 by rapid cooling in an exchange of heat with evaporating and highly compressed water.

Cooler 3 comprises one or more cooling pipes 4 positioned next to one another in a row such that each cooling pipe 4 is associated with a cracking pipe 2 and extends along its axis. The inside diameters of the two types of pipe are usually equal, as illustrated. Cooling pipes 4 open into a gas-collecting line 5. Each cooling pipe 4 is accommodated loosely in an outer pipe 6. At each end of outer pipe 6 are water compartments 7 and 8. Compartments 7 and 8 supply and remove coolant.

The exit of each cracking pipe 2 bifurcates, resulting in an inner section 9 and an outer section 10. Inner section 9 is an extension of cracking pipe 2. Sections 9 and 10 combine at one end. Outer section 10 is welded to lower water compartment 7. The inner section 9 of cracking pipe 2 as slightly separated axially from cooling pipe 4. The space between inner section 9 and outer section 10 is occupied by heat insulation 17.

Water compartments 7 and 8 are made out of a solid and seamless strip. Machined into the strip are separated circular depressions 11, one for each cooling pipe 4. Outer pipe 6 is welded to the side of lower water compartment 7 facing away from cracking pipe 2. The inside diameter of outer pipe 6 at the weld equals the diameter of depression 11. Depression 11 can have the same diameter all the way through. Depression 11 can alternatively be wider at the middle, in which event the depression's diameter can be approximately the width of the space between cooling pipe 4 and outer pipe 6 longer than the inside diameter of outer pipe 6.

Depression 11 extends far enough into the strip that constitutes water compartments 7 and 8 to leave a thin annular floor 12. Cooling pipe 4 is welded into floor 12. The area of the floor is demarcated by the outside diameter of cooling pipe 4 and the diameter of depression 11.

Opening preferably tangentially into each depression 11 at the level of floor 12 is a bore 13. Each bore 13 communicate through a connection 14 with a coolant-supply line 15. The coolant rushes into depression 11 through bore 13 and generates a rotational flow around cooling pipe 4. This flow ensures satisfactory cooling of floor 12 and depression 11 and prevents the deposit of particles on the floor, which could lead to deleterious local overheating.

Each depression 11 also has another bore 16 extending outward at the level of floor 12. The particles that rotate with the coolant in depressions 11 while the system is in operation can be sluiced out through bores 16. Bores 16 communicate for this purpose with a line 18. Line 18 is equipped with an unillustrated decanting valve. The valve can be suddenly and briefly opened to extract particle-loaded coolant.

The coolant, in the form of highly compressed water, is introduced into the depressions 11 in lower water compartment 7 through supply line 15 and flows through the gap between cooling pipe 4 and outer pipe 6. The water evaporates to some extent as it exchanges heat with the cracked gas flowing through cooling pipe 4 and leaves upper water compartment 8 mixed with saturated steam. The mixture is supplied to an unillustrated steam-circulation system, with which coolant-supply line 15 also communicates.

The aforesaid bores 13 and 16 can be exploited as inspection accesses by introducing an endoscope through them and into depressions 11 while the system is not in operation. The endoscope can be employed to reveal the state of the depressions.

FIG. 1 illustrates a cooler 3 with three cooling pipes. The cooler can also have only one or more than three such pipes without exceeding the scope of the present invention.

I claim:

1. A heat exchanger for cooling cracked gas, comprising: at least one cooling pipe surrounded by an outer pipe; said cooling pipe and said outer pipe each having two ends; water compartments for supplying and removing a coolant, one end of each of said cooling pipe and said outer pipe being welded to a first water compartment and the other ends of said, and the phrase outer pipe being welded to a second water compartment; each said water compartment comprising a solid strip having a number of separated and circular-shaped depressions corresponding to the number of cooling pipes; each depression surrounding one cooling pipe; each depression having a diameter at least equal to the inside diameter of said outer pipe; each of said depressions having a height substantially less than the height of said solid strip; each of said depressions being closed on one side of said solid strip by a ring-shaped floor having a slight residual wall thickness substantially equal to the height of said solid strip minus the height of said depression, said cooling pipe being inserted in said ring-shaped floor.

2. A heat exchanger as defined in claim 1, wherein a bore for supplying and removing coolant extends into each depression through a wall of said water compartments.

3. A heat exchanger as defined in claim 2, wherein said bore extends tangentially into said depressions.

4. A heat exchanger as defined in claim 2, including a common coolant-supply line, each said bore communicates with said common coolant-supply line.

5. A heat exchanger as defined in claim 2, wherein another bore extends out of each depression.

6. A heat exchanger for cooling cracked gas, comprising: at least one cooling pipe surrounded by an outer pipe; said cooling pipe and said outer pipe each having two ends; water compartments for supplying and removing a coolant, one end of each of said cooling pipe and said outer pipe being welded to a first water compartment and the other ends of said cooling pipe and said outer pipe being welded to a second water compartment; each said water compartment comprising a solid strip having a number of separated and circular-shaped depressions corresponding to the number of cooling pipes; each depression surrounding one cooling pipe; each depression having a diameter at least equal to the inside diameter of said outer pipe; each of said depressions having a height substantially less than the height of said solid strip; each of said depressions being closed on one side of said solid strip by a ring-shaped floor having a slight residual wall thickness substantially equal to the height of said solid strip minus the height of said depression, said cooling pipe being inserted in said ring-shaped floor; a bore for supplying and removing coolant extending into each depression through a wall of said compartments; said bore extending tangentially into said depressions; a common coolant-supply line, each said bore communicating with said common coolant-supply line; and another bore extending out of each depression.

* * * * *